US010337778B2

(12) United States Patent
Ding et al.

(10) Patent No.: US 10,337,778 B2
(45) Date of Patent: Jul. 2, 2019

(54) ECONOMIZER COMPONENT AND REFRIGERATION SYSTEM THEREOF

(71) Applicant: Carrier Corporation, Farmington, CT (US)

(72) Inventors: Haiping Ding, Shanghai (CN); Yuequn Ge, Shanghai (CN); Haitao Zhang, Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/743,889

(22) PCT Filed: Jul. 12, 2016

(86) PCT No.: PCT/US2016/041853
§ 371 (c)(1),
(2) Date: Jan. 11, 2018

(87) PCT Pub. No.: WO2017/011437
PCT Pub. Date: Jan. 19, 2017

(65) Prior Publication Data

US 2018/0209705 A1 Jul. 26, 2018

(30) Foreign Application Priority Data

Jul. 13, 2015 (CN) ..... 2015 1 0406087

(51) Int. Cl.
*F25B 43/00* (2006.01)
*F25B 1/10* (2006.01)
*F25B 41/06* (2006.01)

(52) U.S. Cl.
CPC ..... *F25B 43/00* (2013.01); *F25B 1/10* (2013.01); *F25B 41/065* (2013.01); *F25B 2400/13* (2013.01); *F25B 2500/18* (2013.01)

(58) Field of Classification Search
CPC ..... F25B 43/00; F25B 41/065; F25B 1/10; F25B 2500/18; F25B 2400/13
See application file for complete search history.

(56) References Cited

U.S. PATENT DOCUMENTS 3,553,974 A * 1/1971 Osborne ..... F25B 1/10 62/115
4,232,533 A * 11/1980 Lundblad ..... F25B 1/10 62/509

(Continued)

FOREIGN PATENT DOCUMENTS

| | | | |
|---|---|---|---|
| CN | 202928188 | U | 5/2013 |
| KR | 20130097867 | A | 9/2013 |
| WO | 2014092850 | A1 | 6/2014 |

OTHER PUBLICATIONS

International Search Report and Written Opinion for application PCT/US2016/041853, dated Oct. 4, 2016, 10 pages.

*Primary Examiner* — Emmanuel Duke
(74) *Attorney, Agent, or Firm* — Cantor Colburn LLP

(57) ABSTRACT

The present invention provides an economizer component, including: a housing; an economizer chamber and an inter-stage flow path chamber, formed inside the housing by using a separator; a condenser connecting port and an evaporator connecting port, disposed on the economizer chamber; a first connecting port and a second connecting port, connected in a multi-stage compressor unit and disposed on the inter-stage flow path chamber; and the economizer chamber being in fluid connection with the inter-stage flow path chamber inside the housing. The economizer component provided in the present invention can reduce complexity of pipe passages of a refrigeration system in which the economizer component is applied.

17 Claims, 1 Drawing Sheet

(56) References Cited

U.S. PATENT DOCUMENTS

| | | | | |
|---|---|---|---|---|
| 4,476,695 | A * | 10/1984 | Epps | B01D 53/002 62/512 |
| 5,692,389 | A * | 12/1997 | Lord | F25B 5/02 62/218 |
| 5,806,327 | A | 9/1998 | Lord et al. | |
| 6,851,277 | B1 * | 2/2005 | Sishtla | F25B 43/006 62/503 |
| 7,856,834 | B2 | 12/2010 | Haley | |
| 8,356,491 | B2 | 1/2013 | Taras et al. | |
| 8,375,741 | B2 | 2/2013 | Taras et al. | |
| 8,627,680 | B2 | 1/2014 | Haley et al. | |
| 8,844,318 | B2 | 9/2014 | James et al. | |
| 9,890,977 | B2 * | 2/2018 | Li | F25B 43/00 |
| 2009/0205361 | A1 * | 8/2009 | James | F25B 43/00 62/510 |
| 2010/0043475 | A1 | 2/2010 | Taras et al. | |
| 2010/0058781 | A1 | 3/2010 | Lifson et al. | |
| 2010/0326100 | A1 | 12/2010 | Taras et al. | |
| 2011/0036110 | A1 | 2/2011 | Fujimoto et al. | |
| 2012/0285185 | A1 | 11/2012 | Huff | |
| 2014/0151015 | A1 | 6/2014 | Sun et al. | |

* cited by examiner

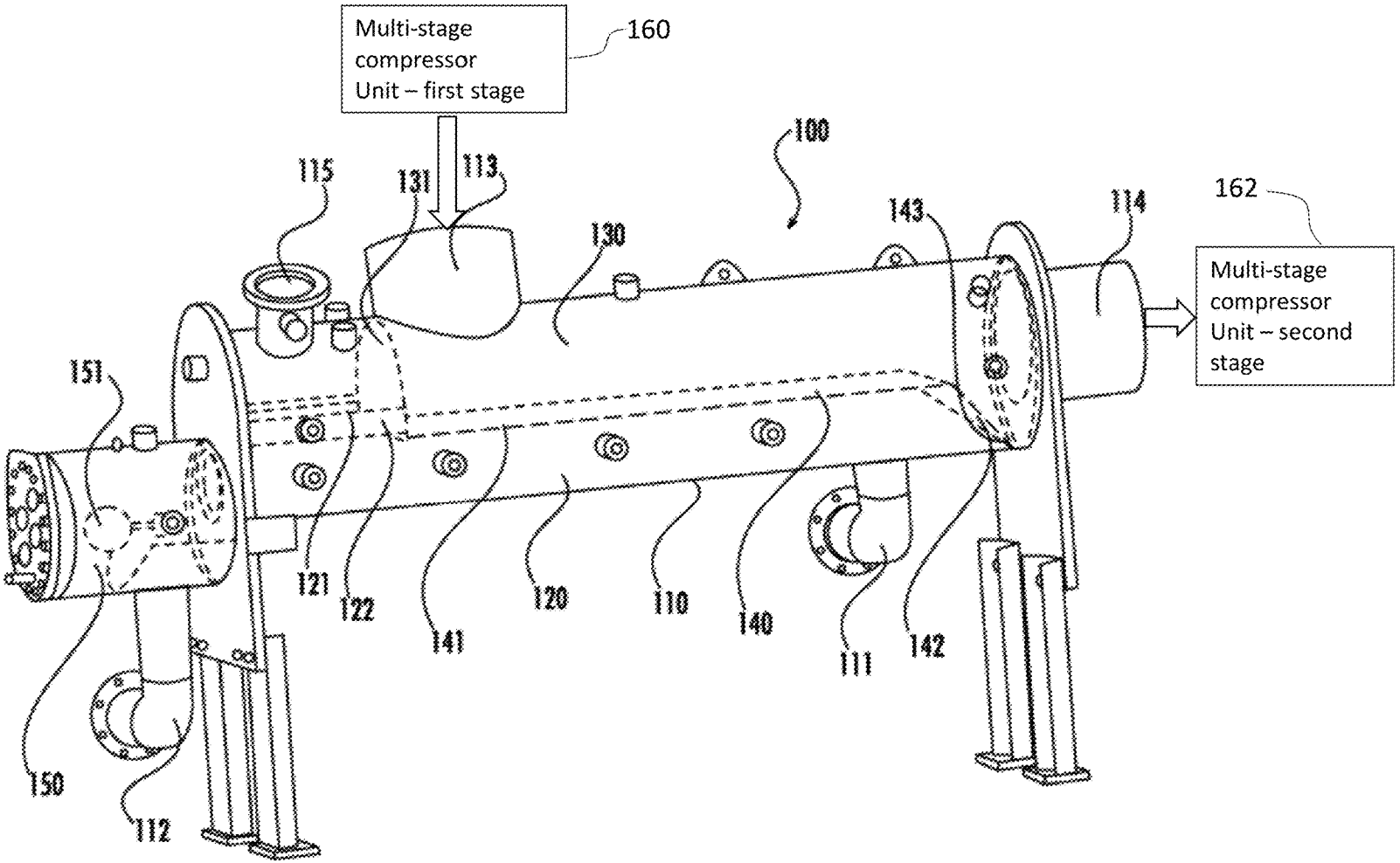
Multi-stage compressor Unit – first stage
160
Multi-stage compressor Unit – second stage
162
100
110
111
112
113
114
115
120
121
122
130
131
140
141
142
143
150
151

ECONOMIZER COMPONENT AND REFRIGERATION SYSTEM THEREOF

TECHNICAL FIELD

The present invention relates to a refrigeration system, and more particularly, the present invention relates to an improved economizer component in a refrigeration system.

BACKGROUND

An economizer is a common member in a large-scale refrigeration system and is used to enable throttling and evaporation of a part of a refrigerant to absorb heat, so as to enable another part of the refrigerant to achieve supercooling. In many cases, the economizer may be used in a refrigeration system having a multi-stage compressor unit. In a working condition in which evaporation temperature is relatively low, a normal multi-stage compressor unit has various defects such as reduced efficiency, reduced refrigerating capacity, and relatively high exhaust temperature. If the economizer is used to perform air supplementation between compression stages of the multi-stage compressor unit, efficiency of refrigeration cycles can be improved, refrigerating capacity can be improved, and exhaust temperature of a compressor can be reduced.

An economizer is an essential member in a large-scale refrigeration system, and in the overall design of the refrigeration system, inevitably, an overall layout of the refrigeration system after the economizer is applied needs to be considered. The connecting pipe passages between the economizer and other members also need to be designed together. As a result, an overall layout of a large-scale refrigeration unit becomes troublesome and complex. In addition, complexity of disposing of pipe passages also indirectly affects running efficiency and reliability of the system.

SUMMARY

An objective of the present invention is to provide an economizer component, so as to simplify complexity of pipe passages of a refrigeration system in which the economizer component is applied.

An objective of the present invention is to further provide a refrigeration system having the economizer component, so as to simplify complexity of an overall layout of a refrigeration unit, thereby ensuring running efficiency and reliability of the system.

To implement the foregoing objectives or other objectives, the present invention provides the following technical solutions.

According to an aspect of the present invention, an economizer component is provided, including: a housing; an economizer chamber and an inter-stage flow path chamber, formed inside the housing by using a separator; a condenser connecting port and an evaporator connecting port, disposed on the economizer chamber; a first connecting port and a second connecting port, connected in a multi-stage compressor unit and disposed on the inter-stage flow path chamber; and the economizer chamber being in fluid connection with the inter-stage flow path chamber.

According to another aspect of the present invention, a refrigeration system is further provided, including: the economizer component described above and a multi-stage compressor unit, where the inter-stage flow path chamber is connected in the multi-stage compressor unit by using the first connecting port and the second connecting port.

BRIEF DESCRIPTION OF THE DRAWINGS

FIG. 1 is a schematic diagram of an embodiment of an economizer component of the present invention.

DETAILED DESCRIPTION

Referring to FIG. 1, an embodiment of an economizer component 100 of the present invention is provided. The economizer component 100 has an external structure similar to that of a conventional economizer, that is, has a cylindrical housing 110 made of corrosion-resistant metal. Two internal spaces are formed inside the housing 110 by using a separator 140: an economizer chamber 120 and an inter-stage flow path chamber 130. A condenser connecting port 111, an evaporator connecting port 112, a first connecting port 113, and a second connecting port 114 are disposed on the housing 110. The condenser connecting port 111 and the evaporator connecting port 112 are in fluid connection with the economizer chamber 120. The first connecting port 113 and the second connecting port 114 are in fluid connection with the inter-stage flow path chamber 130. In addition, it should be known that, in order to implement a conventional air supplementation function of an economizer, the economizer chamber 120 should further be in fluid connection with the inter-stage flow path chamber 130. The economizer chamber 120 is further provided with a float chamber 150 upstream of the evaporator connecting port 112, and a float valve 151 is provided in the float chamber 150 to control on/off and an opening degree according to a liquid level in the float chamber 150.

In such an arrangement, a refrigerant that flows into the economizer chamber 120 from a condenser is throttled into a gas-phase state and a liquid-phase state. The gas-phase refrigerant may directly flow into the inter-stage flow path chamber 130, to implement inter-stage air supplementation of a multi-stage compressor unit, so as to achieve effects of reducing exhaust temperature of the multi-stage compressor unit and improving quality. Moreover, inter-stage pipe passages specially used for the multi-stage compressor unit are no longer needed, thereby avoiding a problem of complex design of pipe passages, so that large-scale bent connecting pipe passages no longer exist, and an overall structure becomes more compact and simplified.

To better implement the objectives of the present invention, design positions of structural features are also very important.

For the two chambers formed inside the housing 110 by using the separator 140, the economizer chamber 120 is optionally located at a lower portion of the housing 110, and the inter-stage flow path chamber 130 is located at an upper portion of the housing 110. In this way, it facilitates the refrigerant in two phases to complete separation of the gas-phase refrigerant and the liquid-phase refrigerant in the economizer chamber 120, and it further facilitates the gas-phase refrigerant floating above the liquid-phase refrigerant to be sucked into the inter-stage flow path chamber 130, thereby facilitating inter-stage air supplementation of the multi-stage compressor unit.

In addition, it can be known according to the foregoing description that the so-called economizer chamber 120 and the so-called inter-stage flow path chamber 130 are two spaces that are defined according to the effects of the two chambers in the unit, and the two chambers are not completely isolated, and instead a structure of fluid connection is provided. Specifically, an end of the separator 140 near the second connecting port 114 and an end portion or a bottom portion of the housing 110 are substantially sealed (except for a liquid discharge hole that is described hereinafter), a compensation port 131 may be formed at an end of the separator 140 near the evaporator connecting port 112, and fluid connection between the economizer chamber 120 and the inter-stage flow path chamber 130 is implemented by using the compensation port 131.

Optionally, for ease of formation, the compensation port 131 may be directly formed to have a half-moon shape.

In addition, although the refrigerant in two phases may be throttled and separated into the gas-phase refrigerant and the liquid-phase refrigerant in the economizer chamber 120, such separation is not thorough or absolute. That is, the gas-phase refrigerant may be mixed with tiny liquid drops, and the liquid-phase refrigerant may be mixed with gas. In such a case, to ensure the purity of the gas-phase refrigerant sucked into the inter-stage flow path chamber 130, a demisting member upstream of the compensation port may be further provided to effectively filter out the liquid-phase refrigerant, thereby preventing an excessive amount of the liquid-phase refrigerant from entering a compressor to cause a fluid hammer phenomenon.

Optionally, a demister member may be disposed at a position higher than that of the separator 140. Such an arrangement considers the following: Because of an effect of gas-liquid separation of the economizer chamber 120, more of the liquid-phase refrigerant usually exists in a lower-portion space, and more of the gas-phase refrigerant usually exists in an upper-portion space. Therefore, even if assuming there is no demister member, a proportion of the liquid-phase refrigerant is lower at a higher position of the economizer chamber 120. Therefore, the demister member is disposed higher than the separator 140, which helps to improve an effect of demisting the liquid-phase refrigerant. Certainly, in this case, the separator 140 needs to be redesigned with a bend that goes upward, so as to seal a gap that exists because of a height difference between the separator 140 and the demister member, thereby preventing the liquid-phase refrigerant from directly entering the inter-stage flow path chamber 130 via the gap.

The demister member herein is required to have an effect of adsorbing or separating misty liquid drops. To implement a relatively more desirable filtering effect, the present invention provides a specific embodiment of a demister member, i.e., a wire-mesh demister 121.

To facilitate installation of the wire-mesh demister 121, in the present invention, insertion slots 122 may be further disposed on two sides inside the housing 110, and a filtering member is disposed in the housing 110 in a manner of being inserted in the insertion slot 122.

It should be noted that when the fluid connection between the economizer chamber 120 and the inter-stage flow path chamber 130 is implemented by using the compensation port 131, an intermediate-level guide vane of the multi-stage compressor unit is required to control the pressure in the economizer chamber 120, and maintain a pressure difference between the economizer chamber 120 and an evaporator, thereby ensuring that the refrigerant effectively flows from the economizer chamber 120 to the evaporator.

In addition, optionally, if a multi-stage compressor unit without an intermediate-level guide vane is applied in the economizer component, the compensation port 131 may be sealed, and instead a damping valve port 115 is disposed on the housing 110 of the economizer component. An end of the damping valve port 115 is connected to the economizer chamber 120, and the other end of the damping valve port 115 is joined with the inter-stage flow path chamber 130 outside the housing 110. In this case, the pressure in the economizer chamber 120 may be adjusted by using a damping valve, so as to maintain a pressure difference between the economizer chamber 120 and the evaporator, thereby ensuring that the refrigerant effectively flows from the economizer chamber 120 to the evaporator. Similar to an intermediate-level guide vane, the objective of adjusting the pressure in the economizer chamber 120 can also be implemented.

In addition, specific position design of several ports also plays an important role for improving the smoothness of flowing of the refrigerant inside the entire economizer component 100. For example, in this embodiment, the condenser connecting port 111 is disposed on a lower right side of the economizer component 100; the evaporator connecting port 112 is disposed on a lower left side of the economizer component 100; the first connecting port 113 is disposed on an upper side of the economizer component 100 and near the compensation port 131; and the second connecting port 114 is disposed at a right end portion of the economizer component 100. In this way, for the refrigerant in two phases that enters the economizer chamber 120 from lower right via the condenser connecting port 111, gas-liquid separation is gradually implemented in the process that the refrigerant flows from right to left. After reaching a left end, the liquid-phase refrigerant goes to the evaporator from the evaporator connecting port 112 at a lower left corner. The gas-phase refrigerant flows into the inter-stage flow path chamber 130 from an upper left corner to the right via the compensation port 131, and is mixed with the gas-phase refrigerant that is sucked into the inter-stage flow path chamber 130 via the first connecting port 113 and that undergoes first-stage compression. Subsequently, the mixed gas-phase refrigerant enters the compressor via the second connecting port 114. The entire flowing process is very stable, and unnecessary turnings or loops do not exist.

In addition, to implement the objective of forming the economizer chamber 120 and the inter-stage flow path chamber 130 inside a cylindrical housing, the design of the separator is particularly important.

As shown in FIG. 1, the separator 140 is generally includes two sections, that is: a first section 141 extending along a longitudinal direction of the housing 110 and a second section 142 that leaves space for the second connecting port 114. The first section 141 has a main effect of forming the economizer chamber 120 and the inter-stage flow path chamber 130 inside the housing 110. The second section 142 is mainly used to enable the gas-phase refrigerant to stably flow into a second stage of the multi-stage compressor unit by providing space, to further reduce a flowing resistance of the gas-phase refrigerant.

Optionally, for the purpose of convenient installation/welding, the first section 141 may be directly disposed as a straight plate.

Optionally, a bend can be directly formed between the first section 141 and the second section 142. To improve the smoothness of flowing, the bend may have a rounded transitional portion.

To simplify the structural design inside the housing 110 and make the refrigerant to flow inside the housing 110 as smooth as possible, the second section 142 may be disposed on a side near the condenser connecting port 111 inside the housing 110.

When the unit stops running, because a bend exists, a part of the liquid-phase refrigerant may accumulate at a bending portion at the second section 142. Therefore, for the objective of preventing liquid accumulation, a liquid discharge hole 143 may be further disposed at a lowest point of the inter-stage flow path chamber 130. For example, the liquid discharge hole 143 may be disposed at the bottom of the second section 142, and opening and closing of the liquid discharge hole 143 is controlled by using an electromagnetic valve. By means of such design, when the unit stops running, the electromagnetic valve is opened to enable the liquid-phase refrigerant to flow into the economizer chamber 120 via the liquid discharge hole 143, and further return to the condenser.

Moreover, the present invention further provides an embodiment of a refrigeration system, in which the foregoing economizer component 100 of the present invention is applied, and a multi-stage compressor unit is also included. The inter-stage flow path chamber 130 is connected to a discharge port of a first stage compressor 160 in the multi-stage compressor unit by using the first connecting port 113, and is connected to a suction port of a second stage compressor 162 in the multi-stage compressor unit by using the second connecting port 114.

In such an arrangement, the refrigeration system no longer needs inter-stage pipe passages specially used for the multi-stage compressor unit, thereby avoiding a problem of complex design of pipe passages, so that a refrigeration unit has only three housing layouts (that is, an evaporator, a condenser, and an economizer), and the overall structure is more compact and simplified.

A working process of the refrigeration system in an embodiment of the present invention is described below with reference to FIG. 1 and other members of the refrigeration system that are not shown.

When the refrigeration system starts to work, the refrigerant that flows out from the condenser enters the economizer chamber 120 from lower right via the condenser connecting port 111; and flows from right to left inside the economizer chamber 120, where in the process of flowing, separation of a gas phase and a liquid phase is performed at the same time. After reaching a left end of the economizer chamber 120, on the one hand, the liquid-phase refrigerant flows into the float chamber 150 at a lower left corner. After a certain amount of the liquid-phase refrigerant is accumulated in the float chamber 150, the float valve 151 is opened, and the liquid-phase refrigerant flows into the evaporator via the evaporator connecting port 112 to perform heat exchange, and subsequently returns to the compressor. On the other hand, after the wire-mesh demister 121 on an upper left side filters out a part of misty liquid drops of the refrigerant that are mixed in the gas-phase refrigerant, the gas-phase refrigerant goes to the right via the compensation port 131 and is sucked into the inter-stage flow path chamber 130, and is mixed with the gas-phase refrigerant that is sucked into the inter-stage flow path chamber 130 via the first connecting port 113 and that undergoes first-stage compression. The mixed gas-phase refrigerant is sucked into the compressor via the second connecting port 114. Such a cycle is repeated over and over again.

In the description of the present invention, it needs to be understood that direction or position relationships indicated by "on", "under", "front", "rear", "left", "right", and the like are direction or position relationships based on the accompanying drawings, and are only used to facilitate description of the present invention and to simplify description, rather than to indicate or imply that the discussed apparatuses or features must be in specific directions and be configured and operated in specific directions. Therefore, the direction or position relationships should not be construed as a limitation to the present invention.

The economizer component and the refrigeration system having the economizer component of the present invention are mainly described by using the foregoing examples. Although only some implementation manners of the present invention are described, a person of ordinary skill in the art should understand that the present invention may be implemented in many other forms without departing from the spirit and scope of the present invention. Therefore, the presented examples and implementation manners are regarded to be schematic rather than limitative, and the present invention may cover various changes and replacements without departing from the spirit and scope of the present invention that are defined in the appended claims.

The invention claimed is:

1. An economizer component, comprising: a housing; an economizer chamber and an inter-stage flow path chamber, formed inside the housing by using a separator; a condenser connecting port and an evaporator connecting port, disposed on the economizer chamber; a first connecting port and a second connecting port, connected in a multi-stage compressor unit and disposed on the inter-stage flow path chamber; and the economizer chamber being in fluid connection with the inter-stage flow path chamber.

2. The economizer component according to claim 1, wherein the separator comprises a first section extending along a longitudinal direction of the housing.

3. The economizer component according to claim 2, wherein the first section is a straight plate.

4. The economizer component according to claim 2, wherein the separator further comprises a second section that leaves space for the second connecting port, and a bend is formed between the first section and the second section.

5. The economizer component according to claim 4, wherein the second section is disposed on a side near the condenser connecting port inside the housing.

6. The economizer component according to claim 1, wherein a liquid discharge hole is provided at a lowest point inside the inter-stage flow path chamber, and opening and closing of the liquid discharge hole are controlled by an electromagnetic valve.

7. The economizer component according to claim 1, wherein, when the economizer component is in a running state, the economizer chamber is located at a lower portion of the housing, and the inter-stage flow path chamber is located at an upper portion of the housing.

8. The economizer component according to claim 1, wherein the separator forms a compensation port inside the housing, and the economizer chamber is in fluid connection with the inter-stage flow path chamber by using the compensation port.

9. The economizer component according to claim 8, wherein the compensation port is disposed on a side near the evaporator connecting port inside the housing.

10. The economizer component according to claim 8, wherein the compensation port has a half-moon shape.

11. The economizer component according to claim 8, further comprising: a demister member upstream of the compensation port, and when the economizer component is in a running state, the demister member being used to filter out a liquid-phase refrigerant that flows via the economizer chamber to the inter-stage flow path chamber.

12. The economizer component according to claim 11, wherein when the economizer component is in a running state, the demister member is disposed at a position higher than that of the separator.

13. The economizer component according to claim 11, wherein a filtering member is a wire-mesh demister.

14. The economizer component according to claim 11, wherein an insertion slot is disposed on an inner side of the housing, and the demister member is placed inside the housing by using the insertion slot.

15. The economizer component according to claim 1, wherein a damping valve port is further disposed on the housing, wherein an end of the damping valve port is connected to the economizer chamber, and the other end of the damping valve port is joined with the inter-stage flow path chamber outside the housing; and the economizer chamber is in fluid connection with the inter-stage flow path chamber by using the damping valve port.

16. The economizer component according to claim 1, wherein the economizer chamber is further provided with a float chamber upstream of the evaporator connecting port.

17. A refrigeration system, comprising: the economizer component according to claim 1 and the multi-stage compressor unit, wherein the inter-stage flow path chamber is connected in the multi-stage compressor unit by using the first connecting port and the second connecting port.

* * * * *